US007584732B2

(12) United States Patent
Falkowski

(10) Patent No.: US 7,584,732 B2
(45) Date of Patent: Sep. 8, 2009

(54) SHAFT-MOUNTED ROCKER ARM ARRANGEMENT

(75) Inventor: Alan G. Falkowski, Lake Orion, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 0 days.

(21) Appl. No.: 11/626,504

(22) Filed: Jan. 24, 2007

(65) Prior Publication Data

US 2007/0169735 A1 Jul. 26, 2007

Related U.S. Application Data

(60) Provisional application No. 60/761,891, filed on Jan. 25, 2006.

(51) Int. Cl.
*F01L 1/18* (2006.01)

(52) U.S. Cl. ..... 123/90.41; 123/90.39; 29/888.2

(58) Field of Classification Search ..... 123/90.41, 123/90.39; 29/888.2
See application file for complete search history.

(56) References Cited

U.S. PATENT DOCUMENTS

| | | | | |
|---|---|---|---|---|
| 4,724,804 | A * | 2/1988 | Wirth | 123/90.39 |
| 4,741,301 | A * | 5/1988 | Patterson | 123/90.22 |
| 4,841,922 | A * | 6/1989 | Taniguchi et al. | 123/90.51 |
| 5,729,899 | A * | 3/1998 | Kaywood et al. | 29/888.1 |
| 6,755,172 | B2 * | 6/2004 | Neubock et al. | 123/193.5 |

* cited by examiner

*Primary Examiner*—Zelalem Eshete
(74) *Attorney, Agent, or Firm*—Ralph E. Smith

(57) ABSTRACT

The present invention is a shaft-mounted rocker arm arrangement for an internal combustion engine which provides simplified assembly and disassembly by allowing individual rocker arms to be added or removed separately and without removing the rocker shaft. The present invention utilizes a rocker shaft and a rocker arm rotatably coupled to the rocker shaft. The rocker shaft includes a flat portion arranged to receive the rocker arm. The rocker arm includes a body portion and a curved arm portion arranged to match a curvature of the rocker shaft, and arranged to engage more than 180 degrees of the rocker shaft.

18 Claims, 5 Drawing Sheets

SHAFT-MOUNTED ROCKER ARM ARRANGEMENT

CROSS-REFERENCE TO RELATED APPLICATION(S)

The present invention non-provisional patent application claims the benefit of priority to U.S. Provisional Patent Application No. 60/761,891, filed Jan. 25, 2006, and entitled "ROCKER ARM ARRANGEMENT", which is important in-full by reference herein.

FIELD OF THE INVENTION

The present invention relates generally to a valvetrain for an automotive engine and, more particularly, to a valvetrain having a shaft-mounted rocker arm arrangement for an automotive internal combustion engine.

BACKGROUND OF THE INVENTION

Shaft-mounted rocker arms are configured to rotate about a rocker shaft when actuated by a camshaft to operate intake and exhaust valves. The rocker shaft is configured to support the rocker arms as they rotate. Typically, there is a rocker arm for each intake and exhaust valve. Traditionally, rocker arms include an opening where each rocker arm is inserted through the rocker shaft. The opening can be at one end of the rocker arm or in the middle of the rocker arm.

Assembly of traditional shaft-mounted rocker arms includes inserting each rocker arm into the rocker shaft in sequence, and placing spacers on the rocker shaft to prevent movement laterally along the rocker shaft by the rocker arms. For maintenance and repair of traditional shaft-mounted rocker arms, the rocker shaft and rocker arms must be disassembled. For example, removal and replacement of a rocker arm in the middle of the rocker shaft requires removing the entire rocker shaft and several rocker arms, as well as spacers on the rocker shaft and the like.

Disadvantageously, assembly and disassembly of existing of existing shaft-mounted rocker arms is challenging due to the inability to remove a rocker arm without removing the shaft and other rocker arms. Additionally, the opening in the rocker arms is typically circular, and matched to the size of the rocker shaft. This prevents the use of a formation in the rocker arm to engage a groove in the rocker shaft to locate the rocker arms on the rocker shaft because the formation would prevent the rockers arms from sliding on the rocker shaft.

Thus, there exists a need for a shaft-mounted rocker arrangement which overcomes these limitations.

BRIEF SUMMARY OF THE INVENTION

In various exemplary embodiments, the present invention provides a shaft-mounted rocker arm arrangement for an internal combustion engine which provides simplified assembly and disassembly by allowing individual rocker arms to be added or removed individually and without removing the rocker shaft. The present invention utilizes a rocker shaft and a rocker arm rotatably coupled to the rocker shaft. The rocker shaft includes a flat portion arranged to receive the rocker arm. The rocker arm includes a body portion and a curved arm portion arranged to match a curvature of the rocker shaft, and arranged to engage more than 180 degrees of the rocker shaft.

In an exemplary embodiment of the present invention, a shaft-mounted rocker arm arrangement includes a rocker arm including a body portion and a curved arm portion, and a rocker shaft including a flat portion arranged to receive the curved arm portion of the rocker arm, wherein the curved arm portion is arranged to match a curvature of the rocker shaft, and wherein the rocker arm is rotatably coupled to the rocker shaft. The curved arm portion is arranged to engaged more than 180 degrees of the rocker shaft. The rocker arm is arranged to be placed over the flat portion of the rocker shaft, and then translated axially along the rocker shaft to an operating position whereby the rocker arm is captured by the rocker shaft. Optionally, the flat portion is machined flat or formed flat.

In another exemplary embodiment of the present invention, a shaft-mounted rocker arm arrangement includes a rocker shaft including a flat portion and a groove, and a rocker arm including a body portion and a curved arm portion, wherein the curved arm portion comprises a formation and a curvature arranged to match a curvature of the rocker shaft, and the formation engages the groove thereby axially locating the rocker arm. The curved arm portion engages more than 180 degrees of the rocker shaft. The rocker shaft rotates in the plane established by the groove. The rocker arm is arranged to be placed over the flat portion of the rocker shaft, and then rotated about the rocker shaft to engage the formation in the groove. Optionally, the flat portion is machined flat or formed flat.

In yet another exemplary embodiment of the present invention, a method of mounting a rocker arm shaft includes placing the rocker arm over a flat portion on the rocker shaft, and a capturing a curved arm portion of the rocker arm with the rocker shaft, wherein in curved arm portion includes a curvature matching a curvature of the rocker shaft, and the curved arm portion engages more than 180 degrees of the rocker shaft. Optionally, the capturing step includes translating the rocker arm axially along the rocker shaft to an operating position. Alternatively, the capturing step includes rotating the rocker arm about the rocker shaft engage a formation in the curved arm portion in a groove in the rocker shaft. Optionally, the flat portion is machined flat or formed flat, and sized accordingly to allow the curved arm portion to be placed over the rocker shaft.

BRIEF DESCRIPTION OF THE DRAWINGS

The present invention is illustrated and described herein with reference to the various drawings, in which like reference numbers denote like system components, respectively, and which.

DETAILED DESCRIPTION OF THE INVENTION

In various exemplary embodiments, the present invention provides a shaft-mounted rocker arm arrangement for an internal combustion engine which provides simplified assembly and disassembly by allowing individual rocker arms to be added or removed individually and without removing the rocker shaft. The present invention utilizes a rocker shaft and a rocker arm rotatably coupled to the rocker shaft. The rocker shaft includes a flat portion arranged to receive the rocker arm. The rocker arm includes a body portion and a curved arm portion arranged to match a curvature of the rocker shaft, and arranged to engage more than 180 degrees of the rocker shaft.

In an exemplary embodiment, the rocker arm is arranged to be placed over the rocker shaft flat portion and then translated axially along the rocker shaft to an operating position whereby the rocker arm is captured by the rocker shaft, and held in place on the rocker shaft with spacers. In another exemplary embodiment, the rocker shaft includes a groove, and the rocker arm includes a formation in the curvature configured to engage the groove. The rocker arm is arranged to be placed over the rocker shaft flat portion and then rotated about the rocker shaft to an operating position wherein the formation engages the groove thereby axially locating the rocker arm and wherein the rocker arm is captured by the rocker shaft.

Figure 1A:
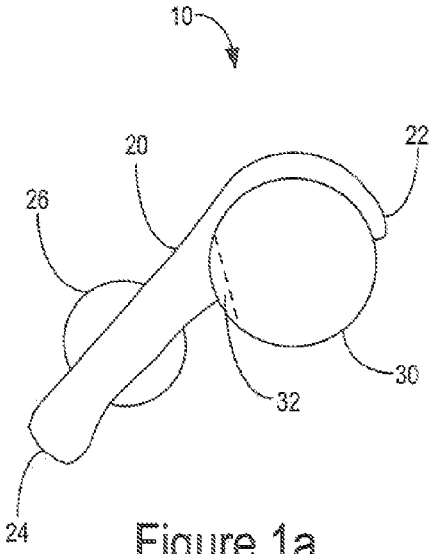
FIGS. 1*a* through 1*d* illustrate sectional and front views of a first exemplary embodiment of a rocker arm arrangement.
Figure 1B:
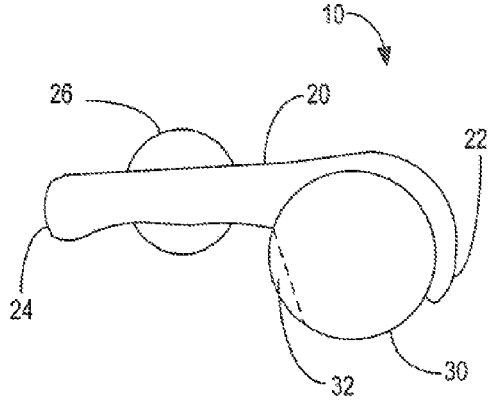
Figure 1C:
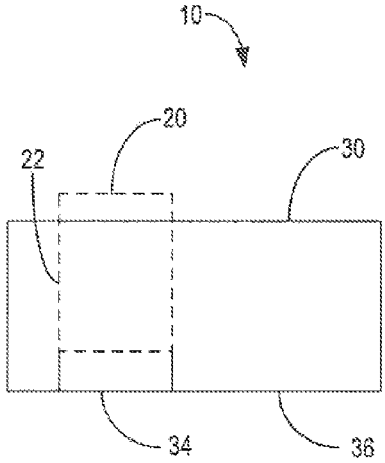
Figure 1D:
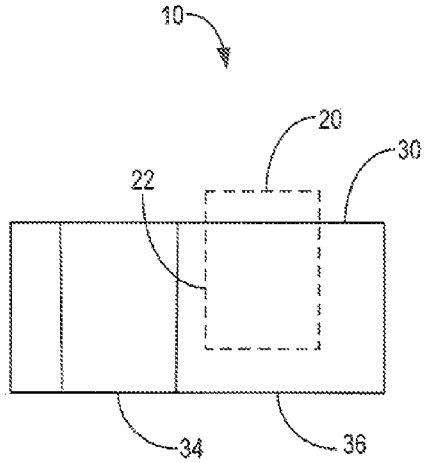

Referring to FIGS. 1*a* through 1*d*, in a first exemplary embodiment of the present invention, a rocker arm arrangement 10 includes a rocker shaft 30 and a rocker arm 20 rotatably coupled to the rocker shaft 30. FIG. 1*a* illustrates a sectional view of the rocker arm arrangement 10 in an installation position, and FIG. 1*b* illustrated a sectional view of the rocker arm arrangement 10 in an operating position. FIGS. 1*c* and 1*d* illustrate from perspective views of the rocker arm arrangement 10 in the installation and operating positions.

The rocker arm 20 includes a body portion 24 and a curved arm portion 22 having an arc greater than 180 degrees but less than 360 degrees (as shown in FIGS. 1*a* and 1*b*) arranged to match a curvature of the rocker shaft 30, and arranged to engage more than 180 degrees of the rocker shaft 30. Also, the rocker arm 20 includes a roller 26 in the body portion 24 which is actuated by a camshaft (not shown) to engage the rocker arm 20. The roller 26 can be a needle roller bearing as is known in the art. The end of the body portion 24 can include attachment devices (not shown), such as a valve adjustment screw, to connect to the valves (not shown). As described herein, the roller 26 can also be a curved surface or the like.

The rocker shaft 30 includes a flat portion 32 arranged to receive the rocker arm 20. The flat portion 32 can be machined flat or formed flat on the rocker shaft 30. The flat portion 32 can be along the entire rocker shaft 32 or spaced along the rocker shaft 32 where the rocker arms 20 are installed. The rocker arm 20 is arranged to be placed over the rocker shaft 30 flat portion 32, and the translated axially along the rocker shaft 30 to an operating position whereby the rocker arm 20 is captured by the rocker shaft 30. Since the curved arm portion 22 engages more than 180 degrees of the rocker shaft 30, once the rocker arm 20 is translated axially past the flat portion 32, the rocker arm 20 is captured by the rocker shaft 30.

In FIG. 1*a*, the rocker arm 20 is placed over the flat portion 32 of the rocker shaft 30, allowing the curved arm portion 22 to engage more than 180 degrees of the rocker shaft 30. The flat portion 32 is sized such that the curved arm portion 22 can be placed over the rocker shaft 30. FIG. 1*b* illustrates the rocker arm arrangement 10 in an operating position. Here, the rocker arm 20 has been translated axially along the rocker shaft 30, and the curved portion 22 has been captured by the rocker shaft 30. In the operating position, the cam shaft actuated the roller 26 causing the curved arm portion 22 to rotate on the rocker shaft 30, and the end of the body portion 24 to engage and disengage the valves.

FIG. 1*c* illustrates a from perspective view of the curved portion 22 of the rocker arm 20 engaged on a portion 34 of the rocker shaft 30 during installation. The portion 34 includes the flat portion 32. In FIG. 1*d*, the rocker arm 20 has been translated axially to a second portion 36 of the rocker shaft 30, and the curved portion 22 has been captured by the rocker shaft 30.

Figure 2A:
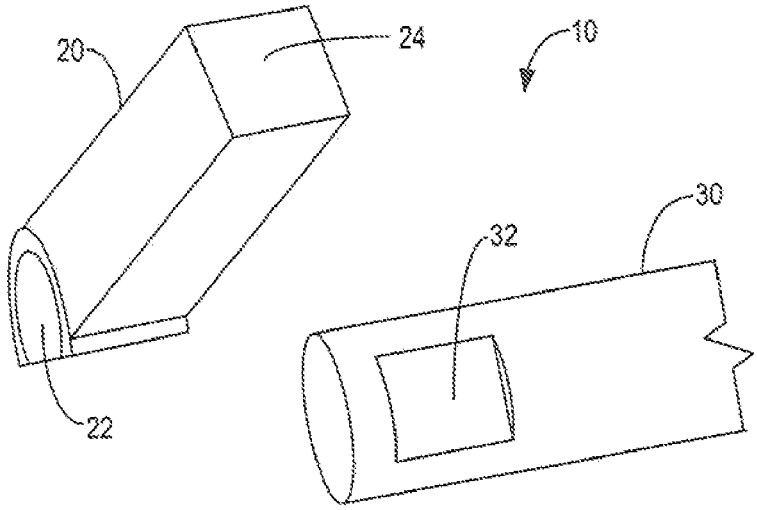
FIGS. 2*a* through 2*c* illustrate perspective views of the first exemplary embodiment of the rocker arm arrangement.
Figure 2B:
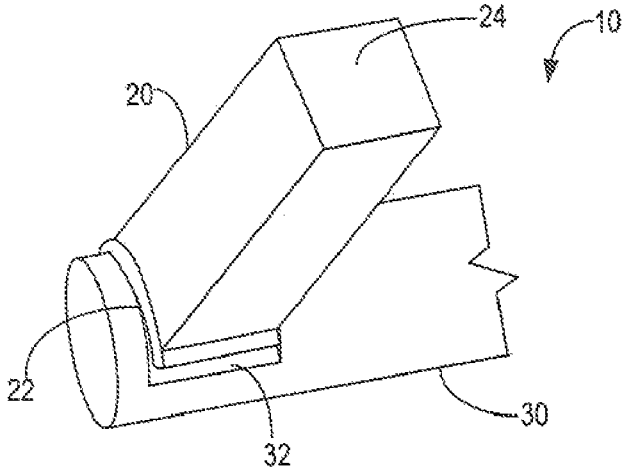
Figure 2C:
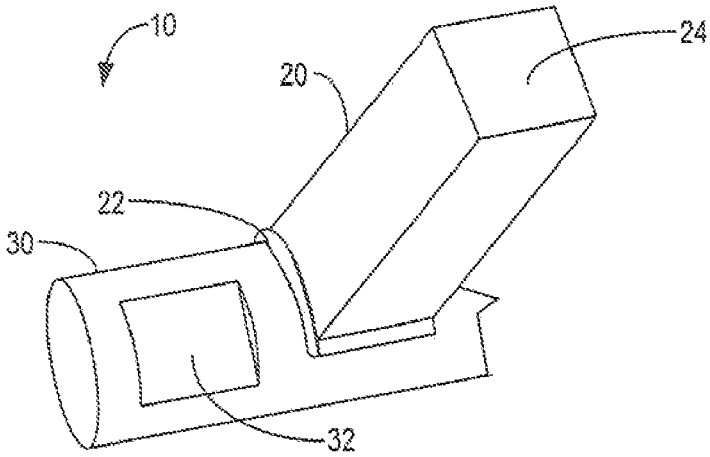

Referring to FIGS. 2*a* through 2*c*, perspective views of the rocker arm arrangement 10 are shown in various positions, according to an exemplary embodiment of the present invention. For the illustration purposes, only the body portion 24 and the curved arm portion 22 are shown on the rocker arm 20 FIGS. 2*a* through 2*c*. The rocker arm 20 includes additional components, such as the roller 26, a valve attachment device, and the like.

FIG. 2*a* illustrates the rocker shaft 30 with the flat portion 32, and a rocker arm 20 with the curved arm portion 22 and the body portion 24. Here, the rocker arm 20 is not attached to the rocker shaft 30. FIG. 2*b* illustrates the rocker arm 20 placed over the flat portion 32 of the rocker shaft 30 such that the curved portion 22 engages the rocker shaft 30. FIG. 2*c* illustrates the rocker arm 20 translated axially along the rocker shaft such that rocker shaft 30 captures the curved portion 22 of the rocker arm 20. Once in this position, spacers (not shown) are added to the rocker shaft 30 to keep the rocker arm 20 from moving laterally along the rocker shaft 30 while in operation. Advantageously, this embodiment easily enables assembly and disassembly of rocker arms 20 from the rocker shaft 30.

Figure 3A:
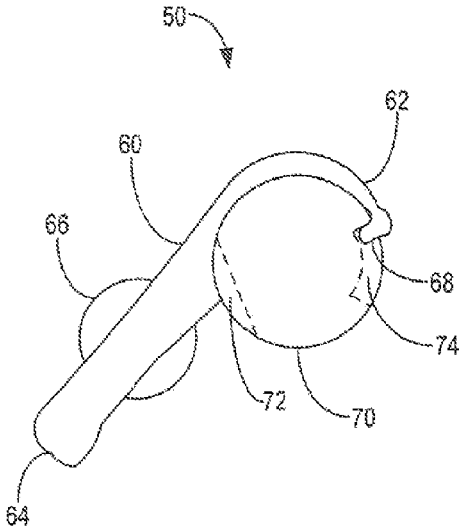
FIGS. 3*a* through 3*d* illustrate sectional, top, and front views of a second exemplary embodiment of a rocker arm arrangement in accordance with the present invention.
Figure 3B:
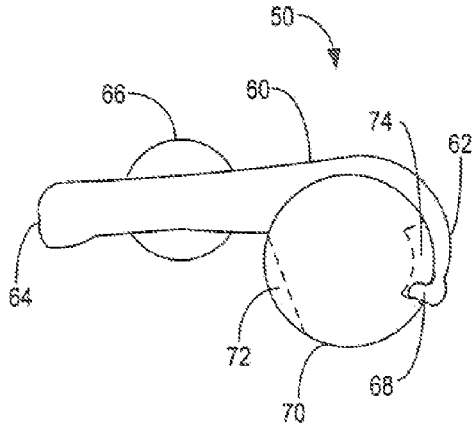
Figure 3C:
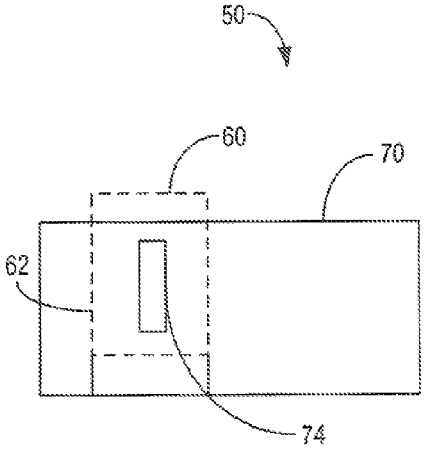
Figure 3D:
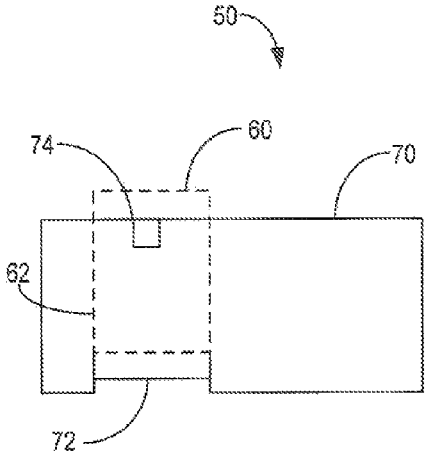

Referring to FIGS. 3*a* through 3*d*, in a second exemplary embodiment of the present invention, a rocker arm arrangement 50 includes a rocker shaft 70 and a rocker arm 60 rotatably coupled to the rocker shaft 70. FIG. 3*a* illustrates a sectional view of the rocker arm arrangement 50 in an installation position, and FIG. 3*b* illustrated a sectional view of the rocker arm arrangement 50 in an operating position. FIG. 3*c* and 3*d* illustrate front and top perspective views of the rocker arm arrangement 50.

The rocker arm 60 includes a body portion 64 and a curved arm portion 62 having an arc greater than 180 degrees but less than 360 degrees (as shown in FIGS. 3*a* and 3*b*). The curved arm portion 62 includes a formation 68, and a curvature arranged to match a curvature of the rocker shaft 70, and arranged to engage more than 180 degrees of the rocker shaft 70. Also, the rocker arm 60 includes a roller 66 in the body portion 64 which is actuated by a camshaft (not shown) to engage the rocker arm 60. The roller 66 can be a needle roller bearing as is known in the art. The end of the body portion 64 can include attachment devices (not shown), such as a valve adjustment screw, to connect to the valves (not shown). As described herein, the roller 66 can also be a curved surface or the like.

The rocker shaft 70 includes a flat portion 72 arranged to receive the rocker arm 60, and a groove 74 arranged to engage the formation 68. The flat portion 72 can be machined flat on the rocker shaft 70. The flat portion 72 can be along the entire rocker shaft 72 or spaced along the rocker shaft 72 where the rocker arms 60 are installed. The rocker arm 60 is arranged to be placed over the rocker shaft 70 flat portion 72, and then rotated about the rocker shaft 70 to an operating position wherein the formation 68 engages the groove 74 thereby axially locating the rocker arm 60, and wherein the rocker arm 60 is captured by the rocker shaft 70. In this embodiment, the rocker arm 60 is captured by the rocker shaft 70 by rotating the rocker arm 60 about the rocker shaft 70 to engage the formation 68 into the groove 74.

The groove 74 and formation 68 are operable to keep the rocker arms 60 from sliding along the axis of the rocker shaft 70. Advantageously, the groove 74 and formation 68 eliminate the need to place spacers on the rocker shaft 70 because the formation 68 engages the groove 74 to locate the rocker arm 60 in place along the rocker shaft 70. The rocker arm 60 rotates in the plane established by the groove 74.

FIG. 3*a* illustrates the rocker arm arrangement 50 in an installation position where the rocker arm 60 is placed over the flat portion 72 of the rocker shaft 70. In this position, the curved arm portion 62 engages more than 180 degrees of the rocker shaft 70. The flat portion 72 is sized such that the curved arm portion 62 and formation 68 can be placed over the rocker shaft 70. FIG. 3*b* illustrates the rocker arm arrangement 50 in an operating position. Here, the rocker arm 60 had been rotated about the rocker shaft 60 to engage the formation 68 in the groove 74 and to capture the curved arm portion 62 by the rocker shaft 70. In this position, the camshaft actuates the roller 26 causing the curved arm portion 62 to rotate along the plane established by the groove 74, and the end of the body portion 64 to engage and disengage the valves.

FIG. 3*c* illustrates a from perspective view of the curved arm portion 62 of the rocker arm 60 on the rocker shaft 70. The groove 74 locates the rocker arm 60 axially on the shaft by engaging the formation 68 in the curved portion 62 of the rocker arm. FIG. 3*d* illustrates a top perspective view of the rocker arm arrangement 50. The flat portion 72 is on the opposite side as the groove 74 with the formation 68.

Figure 4A:
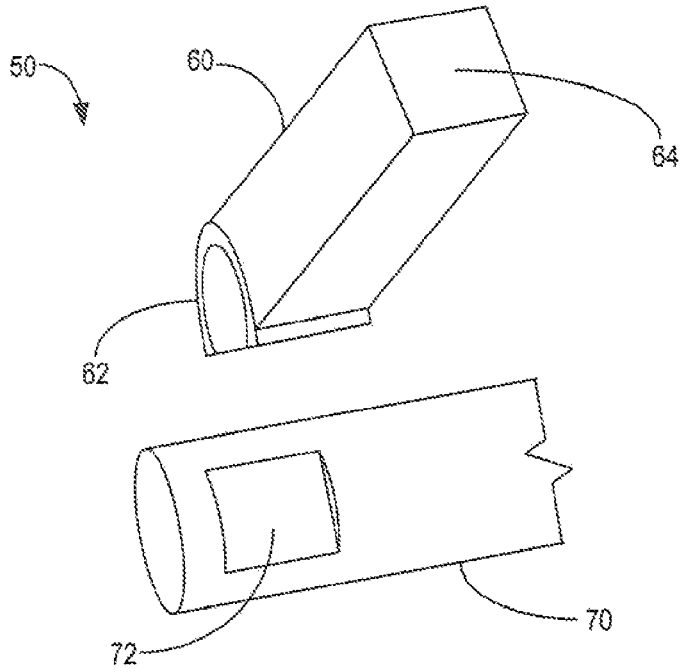
FIGS. 4*a* through 4*b* illustrate perspective views of the second exemplary embodiment of the rocker arm arrangement with the rocker arm not engaged to the rocker shaft.
Figure 4B:
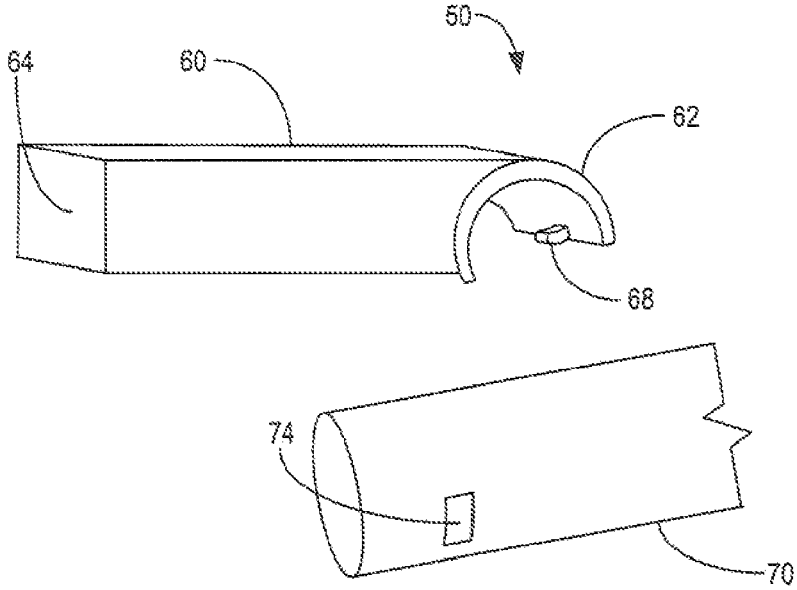

Referring to FIGS. 4*a* and 4*b*, perspective views of the rocker arm arrangement 50 of the second exemplary embodiment of the present invention are illustrated. For illustration purposes, only the body portion 63 and the curved arm portion 62 are shown on the rocker arm 60 in FIGS. 4*a*, 4*b*, 5*a*, and 5*b*. The rocker arm 60 includes additional components, such as roller 66 (shown in FIGS. 3*a* and 3*b*), a valve attachment device, and the like.

FIG. 4*a* illustrates the flat portion 72 of the rocker shaft 70, and an unattached rocker arm 60 in position to engage the flat portion 72. FIG. 4*b* illustrates the opposite side of the rocker shaft from FIG. 4*a* illustrating the groove 74, and a side view if the unattached rocker arm 60 illustrating the formation 68.

Figure 5A:
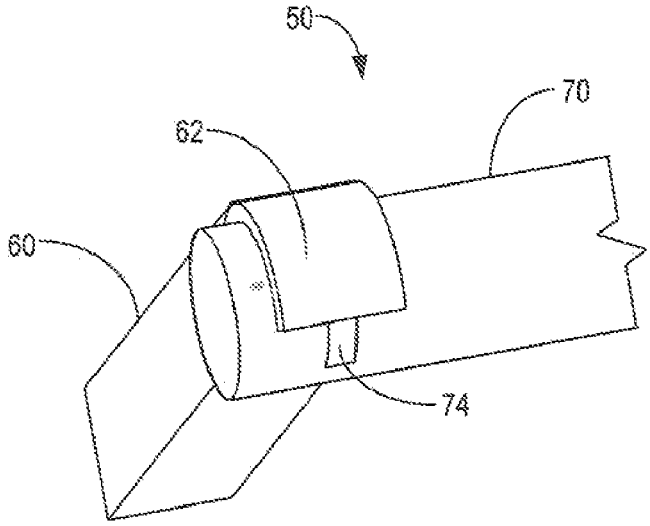
FIGS. 5*a* through 5*b* illustrate perspective views of the second exemplary embodiment of the rocker arm arrangement with the rocker arm connected to the rocker shaft, and illustrating a first and a second operating position.
Figure 5B:
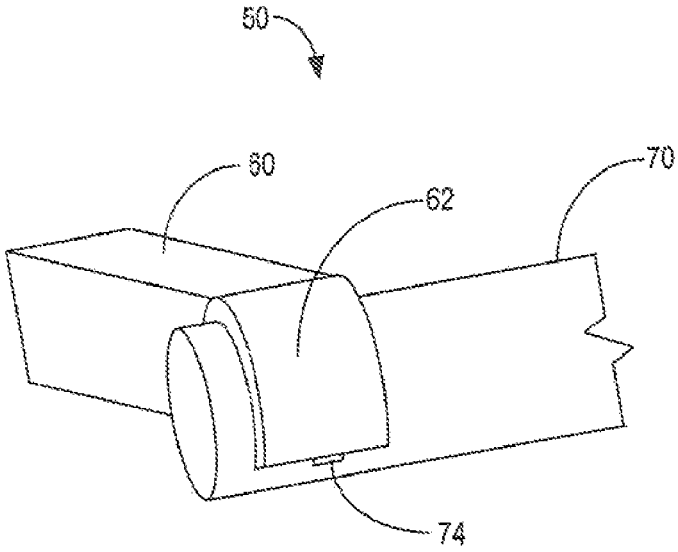

Referring to FIGS. 5*a* and 5*b*, perspective views of the rocker arm arrangement 50 in a first and second operating position are illustrated. As described herein, the curved arm portion 62 of the rocker arm 60 includes the formation 68 which engages the groove 74 in the rocker shaft 70. In FIG. 5*a*, the rocker arm 60 is rotated to a first operating position, and in FIG. 5*b*, the rocker arm is rotated to a second operating position.

Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention and are intended up be covered by the following claims.

What is claimed is:

1. A shaft-mounted rocker arm arrangement comprising:

a rocker arm comprising an elongate body portion and a curved arm portion having an arc greater than 180 degrees but less than 360 degrees, and nowhere 360 degrees; and a rocker shaft comprising flat portion configured to receive the curved arm portion of the rocker arm during assembly of the rocker arm to the rocker shaft, wherein the curved arm portion is arranged to match a curvature of the rocker shaft;

wherein the rocker arm is rotatably coupled to the rocker shaft by engagement between the curved arm portion and the rocker shaft; and wherein the elongate body portion extends outwardly from the curved arm portion in one direction and comprises a valve-cooperating portion disposed at or adjacent the free end of the body portion and a camshaft-cooperating portion disposed between the valve-cooperating portion and the curved arm portion.

2. The shaft-mounted rocker arm arrangement of claim 1, wherein the curved arm portion is arranged to engage more than 180 degrees of the rocker shaft.

3. The shaft-mounted rocker arm arrangement of claim 1, wherein the rocker arm is arranged to be placed over the flat portion of the rocker shaft, and then translated axially along the rocker shaft to an operating position axially spaced from the flat portion of the rocker shaft whereby the rocker arm is captured by the rocker shaft.

4. The shaft-mounted rocker arm arrangement of claim 1, wherein the flat portion is machined flat or formed flat.

5. The shaft-mounted rocker arm arrangement of claim 1, wherein the curved arm portion of the rocker arm further comprises an outwardly protruding formation that is received in a circumferentially extending groove formed in an outer surface of the rocker shaft.

6. A shaft-mourned rocker arm arrangement comprising:

a rocker shall comprising a flat portion and a groove; and a rocker arm comprising a body portion and a curved arm portion having an arc greater than 180 degrees but less than 360 degrees, and nowhere 360 degrees, wherein the curved arm portion comprises a formation and a curvature arranged to match a curvature of the rocker shaft;

wherein the formation engages the groove thereby axially locating the rocker arm; and wherein the body portion extending outwardly from the curved arm portion comprises a valve-cooperating portion disposed at or adjacent a free end of the body portion and a camshaft-cooperating portion disposed between the valve-cooperating portion and the curved arm portion.

7. The shaft-mounted rocker arm arrangement of claim 6, wherein the curved arm portion engages more than 180 degrees of the rocker shaft.

8. The a shaft-mounted rocker arm arrangement of claim 7, wherein the formation outwardly extends from the curved arm portion radially inwardly into the groove in the rocker shaft.

9. The a shaft-mounted rocker arm arrangement of claim 8, wherein the groove extends circumferentially about a portion of the rocker shaft.

10. The shaft-mounted rocker arm arrangement of claim 6, wherein the rocker shaft rotates in the plane established by the groove.

11. The shaft-mounted rocker arm arrangement of claim 6, wherein the rocker arm is arranged to be placed over the flat portion of the rocker shaft, and then rotated about the rocker shaft to engage the formation in the groove.

12. The shaft-mounted rocker arm arrangement of claim 6, wherein the flat portion is machined flat or formed flat.

13. A method of mounting a rocker arm on a rocker shaft, the method comprising the steps of:

placing the rocker arm over a flat portion on the rocker shaft; and capturing a curved arm portion of the rocker arm with the rocker shaft by displacing the curved arm portion axially or radially relative to the flat portion along the rocker shaft in mounting the rocker arm on the rocker shaft, and wherein the curved arm portion has an arc greater than 180 degrees but less than 360 degrees, and nowhere 360 degrees, and comprises a curvature matching a curvature of the rocker shaft, and wherein the curved arm portion engages more than 180 degrees of the rocker shaft.

14. The method of claim 13, wherein the capturing step comprises translating the rocker arm axially along the rocker shaft to an operating position such that the rocker arm is axially spaced from the flat portion when the rocker arm is located in the operating position.

15. The method of claim 13, further comprising the step of attaching spacers on the rocker shaft to locate the rocker arm axially on the rocker shaft.

16. The method of claim 13, wherein the capturing step comprises rotating the rocker arm about the rocker shaft relative to the flat portion until a formation that extends outwardly from the curved arm portion is received in a groove in the rocker shaft.

17. The method of claim 16, wherein the groove in the rocker shaft extends circumferentially about a portion of the rocker shaft.

18. The method of claim 13, wherein the first portion is machined flat or formed flat, and sized accordingly to allow the curved arm portion to be placed over the rocker shaft.

* * * * *